US005569512A

United States Patent [19]

Brawner et al.

[11] Patent Number: 5,569,512

[45] Date of Patent: Oct. 29, 1996

[54] CARD WITH INTEGRATED OVERPRINTING

[75] Inventors: Jon M. Brawner, Duluth; James J. Carides, Lawrenceville; Benny R. Rich, Oakwood; William F. Estep, Jr., Lula, all of Ga.

[73] Assignee: Dittler Brothers Incorporated, Atlanta, Ga.

[21] Appl. No.: 407,185

[22] Filed: Mar. 21, 1995

Related U.S. Application Data

[63] Continuation-in-part of Ser. No. 195,759, Feb. 14, 1994, abandoned, and a continuation-in-part of Ser. No. 260,699, Jun. 16, 1994.

[51] Int. Cl.[6] ..... B42D 15/00; B44F 1/10

[52] U.S. Cl. ..... 428/29; 283/94; 283/100; 283/102; 283/901; 283/903; 428/195; 428/210; 428/211; 428/323; 428/327; 428/916

[58] Field of Search ..... 283/94, 100, 102, 283/901, 903; 428/29, 195, 210, 913–916

[56] References Cited

U.S. PATENT DOCUMENTS

| | | | |
|---|---|---|---|
| 4,212,468 | 7/1980 | Knott | 428/916 |
| 4,299,637 | 11/1981 | Oberdeck et al. | 428/916 |
| 4,507,349 | 3/1985 | Fromson et al. | 428/195 |
| 4,726,608 | 2/1988 | Walton | 283/96 |
| 4,738,473 | 4/1988 | Meloni et al. | 428/916 |
| 4,877,253 | 10/1989 | Arens | 428/916 |
| 4,900,617 | 2/1990 | Smith | 428/916 |
| 5,037,475 | 8/1991 | Chida et al. | 106/403 |
| 5,074,566 | 12/1991 | Desbiens | 428/916 |
| 5,193,815 | 3/1993 | Pollard | 428/916 |
| 5,213,664 | 5/1993 | Hansell | 162/134 |
| 5,228,692 | 7/1993 | Carrick | 428/916 |
| 5,286,061 | 2/1994 | Behm | 283/95 |
| 5,346,258 | 9/1994 | Behm et al. | 283/102 |
| 5,386,985 | 2/1995 | Paris | 273/69 |

OTHER PUBLICATIONS

Photocopy of Iowa Lottery Bingo Card (believed to have been disseminated prior to Sep. 20, 1994).

Advertisement of Unifoil Corporation entitled "Introducing EnviroMet A Recyclable Non–Foil Substrate for Instant Tickets" (one page; believed to have been published Apr. 1993).

Advertisement of Webcraft Games, Inc. entitled "A Message From Webcraft Games" (one page; believed to have been published Jan. 1994).

"Webcraft Reorganizes, Expands," *Public Gaming Magazine*, p. 20 (Sep. 1993).

"Webcraft Goes Green," *Public Gaming Magazine*, p. 11 (Jun. 1993).

"Foil–less printing by SciGames," *Gaming & Wagering Business* (one page; Jul. 15, 1993–Aug. 14, 1993).

"Lottery Pioneer Celebrates 20th Anniversary," *Public Gaming Magazine*, p. 4 (Apr. 1993).

"The Greening of the Lottery," *Gaming & Wagering Business*, pp. 18–19 and 22–23 (Jun. 15, 1993–Jul. 14, 1993).

Advertisement of Scientific Games, Inc. entitled "First There Was The Foil Ticket" (one page; believed to have been published Feb. 1993).

(List continued on next page.)

*Primary Examiner*—B. Hamilton Hess

*Attorney, Agent, or Firm*—Dean W. Russell; Kilpatrick & Cody

[57] ABSTRACT

Cards and methods of securing hidden symbols on cards are disclosed. The cards, such as instant-win lottery tickets, utilize continuous overprint inks that mask the boundaries between their "secure" and "unsecure" portions to inhibit unscrupulous players from successfully tampering with them. By reformulating the overprint inks to permit a single set to be applied to both portions of a card, more vibrant and aesthetically-pleasing graphics may be displayed as well while utilizing fewer printing stations during the printing process.

14 Claims, 2 Drawing Sheets

OTHER PUBLICATIONS

Advertisement of Webcraft Games, Inc. entitled "Rooted In Quality" (one page; believed to have been published in 1993).

Advertisement of BABN Technologies entitled "How Accurate Is Your Information About BABN Technologies" (one page; believed to have been published Nov. 1992).

"Lotteries and the environment," *AILE Review* (seven pages; believed to have been published in 1993).

Promotional Literature of Webcraft Games, Inc. entitled "Compare Webcraft Games' Green Ticket to Other Paper Ticket Stocks Available" (one page; believed to have been disseminated in 1993).

Promotional Literature of Pollard Banknote Limited entitled "Trees of Life" (card with insert; believed to have been disseminated in 1990).

Declaration of Benny R. Rich dated Jun. 10, 1994.

Abstract of Japanese Patent Application No. 63–95277 (Sep. 8, 1988).

CARD WITH INTEGRATED OVERPRINTING

CROSS-REFERENCE TO RELATED APPLICATIONS

This application is a continuation-in-part of U.S. patent application Ser. No. 08/195,759, filed Feb. 14, 1994, entitled "Card,", now abandoned, and of co-pending U.S. patent application Ser. No. 08/260,699, filed Jun. 16, 1994, entitled "Simulated Foil Card," which applications are incorporated herein in their entireties by this reference.

FIELD OF THE INVENTION

This invention relates to a card (such as a lottery ticket or game piece) in which inks are applied continuously over both its "secure" and "unsecure" portions.

BACKGROUND OF THE INVENTION

Many existing instant-win lottery cards or tickets comprise a paper substrate to which foil is laminated. The foil is then coated both to minimize oxidation and to provide an ink-retaining surface onto which symbols may be printed in a selected area. At least one additional sealant may be applied to the inked surface to protect the printed symbols, and a single opaque metallic latex covering used to obscure them from view. Post purchase or distribution, the ticket bearer, or player, typically removes ("scratches off") the latex covering to reveal the hidden symbols. Existing tickets often further include at least one "release" coat interposed between the latex covering and protective coating to facilitate the removal of the latex covering in use.

The area of the ticket in which the symbols are printed and the latex covering is applied is often called the "secure" region of the ticket. Because it contains the symbols that ultimately determine whether a player has won a prize, this region is typically protected from certain types of tampering, both pre- and post-purchase. Co-pending U.S. patent application Ser. No. 08/195,759, for example, discusses various methods of improving the security of the hidden symbols on the card against physical, electrical, magnetic, chemical, and artistic tampering. Using an opaque latex covering itself helps protect the secure region of the ticket from certain optical tampering such as candling. To ensure appropriate adherence to the latex covering, specially-formulated "overprint" inks, typically requiring separate print stations, are used.

By contrast, the remainder of the ticket is known as the "unsecure" portion or area. It often includes aesthetic graphics or vibrant pictures, printed with inks different than those used in the secure region, designed to enhance the overall appeal of the ticket to potential purchasers. The unsecure region need not include an opaque latex covering, as candling or otherwise tampering with it will not reveal the nature or the content of the hidden symbols. Moreover, because the latex covering increases the manufacturing cost of the ticket, applying this covering to the unsecure region is not economical.

Notwithstanding the security devices employed in connection with these tickets, some possibility remains that unscrupulous players may attempt to alter the characteristics of the tickets. Results sought to be achieved in these instances include changing a "losing" ticket to a "winning" one, increasing the value of the prize awarded on a "winning" ticket, or determining, in advance of purchase, whether a ticket is a "winning" one and the nature of the award. Persons to whom tickets are accessible, for example, may attempt to locate the boundaries of the latex coverings and remove those coverings intact so they may observe the (then visible) symbols and, if necessary, reattach the coverings without raising suspicions that tampering has occurred. The structures of existing tickets do not necessarily fully deter these attempts, as the differing inks used in the secure and unsecure regions often demarcate (rather then camouflage) the boundaries of the latex covering.

SUMMARY OF THE INVENTION

The present invention addresses this and other issues respecting existing tickets by applying inks continuously over both their secure and unsecure portions. Unlike current techniques, which use different ink formulations for corresponding portions of the tickets, the present invention utilizes a single formulation adapted to print suitably in both areas. Providing graphical continuity over both regions of a ticket inhibits the improper removal of the latex covering, as the boundaries of the covering are "masked" and thus substantially more difficult to locate. Doing so also improves registration of the components of the overall design, usually resulting in enhanced aesthetic appeal, and eliminates the need for some of the differing inks and print stations now required to produce existing tickets.

Inks of four colors (yellow, magenta, cyan, and black) are often used as part of the present invention. Typical formulations of the inks include, by weight:

| | |
|---|---|
| ethyl acetate | 19–58% |
| colored nitrocellulose chips | 1–25% |
| acrylic resin | 15–25% |
| propyl acetate | 20–60%, |

with a preferred embodiment having, by weight, 30% ethyl acetate, 11% colored nitrocellulose chips, 19% acrylic resin, and 40% propyl acetate. Reformulating the inks in this manner produces acceptable results—including vibrant graphics—over paper, foil, and latex, permitting continuous printing in both the secure and unsecure areas of a ticket. These formulations also reduce "blocking," an industry term describing the transfer of ink from the front of one ticket to the back of another ticket when the tickets are wound in a roll. Polyamide resins (in quantities typically ranging between 1–35% by weight) and spirit-soluble nitrocellulose (in quantities typically ranging between 5–30% by weight and having viscosity of approximately 18–25 cps) may also be added (or substituted for the acrylic resin) if desired, and among the colored nitrocellulose chips suitable for use are Diarylide MX Yellow (color index 13);

Diarylide Yellow (color index 14);

Lithol Rubine Red (color index 54:1);

Phthalocyanine Blue (color index 15:3);

Carbon Black (color index 7);

Red, Scarlet (color index 22); and

Phthalocyanine Green (color index 7).

It is therefore an object of the present invention to provide a card in which inks are applied continuously over both its secure and unsecure portions.

It is another object of the present invention to provide ink formulations suitable for applying over both the paper or foil used in the unsecure area of a ticket and the latex or other synthetic rubber applied in the secure portion of a ticket.

It is also an object of the present invention to provide techniques that eliminate the need for multiple sets of print stations corresponding to multiple formulations of inks.

It is a further object of the present invention to provide a card that masks the boundaries between its secure and unsecure portions.

It is yet another object of the present invention to provide inks including (but not limited to), by weight, 19–58% ethyl acetate, 1–25% colored nitrocellulose chips, and 20–60% propyl acetate, for use in connection with a card such as a lottery ticket or game piece.

It is an additional object of the present invention to provide inks consisting essentially of, by weight, 30% ethyl acetate, 11% colored nitrocellulose chips, 19% acrylic resin, and 40% propyl acetate.

Other objects, features, and advantages of the present invention will become apparent with reference to the remainder of the text and the drawings of this application.

DETAILED DESCRIPTION

Figure 1:
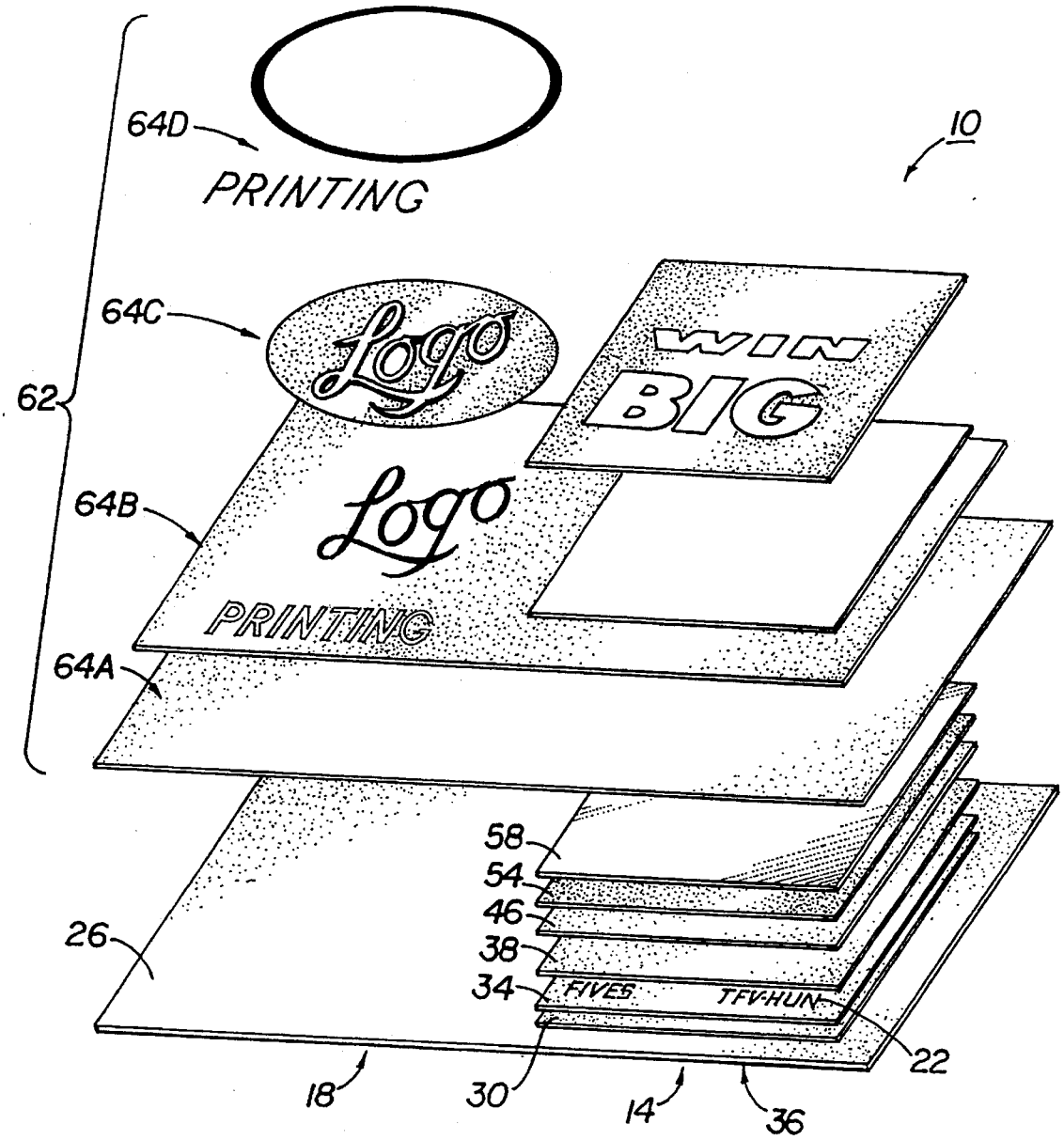
FIG. 1 is an exploded perspective view of a card of the present invention having a paper base.

FIG. 1 illustrates an embodiment of card 10 of the present invention. If desired, card 10 may be divided into "secure" and "unsecure" areas 14 and 18, respectively, with symbols 22 printed in secure area 14. Such symbols 22, initially covered by opaque material (and therefore hidden from view), provide the information sought by the player or purchaser of card 10.

As shown in FIG. 1, card 10 comprises a paper base 26, which may (but need not) be conventional eight or ten point board stock. Unlike the card 10A of FIG. 2, foil is not laminated to base 26 or otherwise used as base 26A. As a result, card 10 is easily recyclable, and base 26 itself may be formed from recycled fibers. Card 10 nevertheless provides many of the advantages of foil-based card 10A, including resistance to known optical, magnetic, chemical, physical, artistic, and electrical compromise techniques and, when subjected to certain chemical tampering, evidence that such tampering has occurred. Alternatively, a synthetic substrate may be used as base 26 or 26A instead of either paper or foil.

Figure 2:
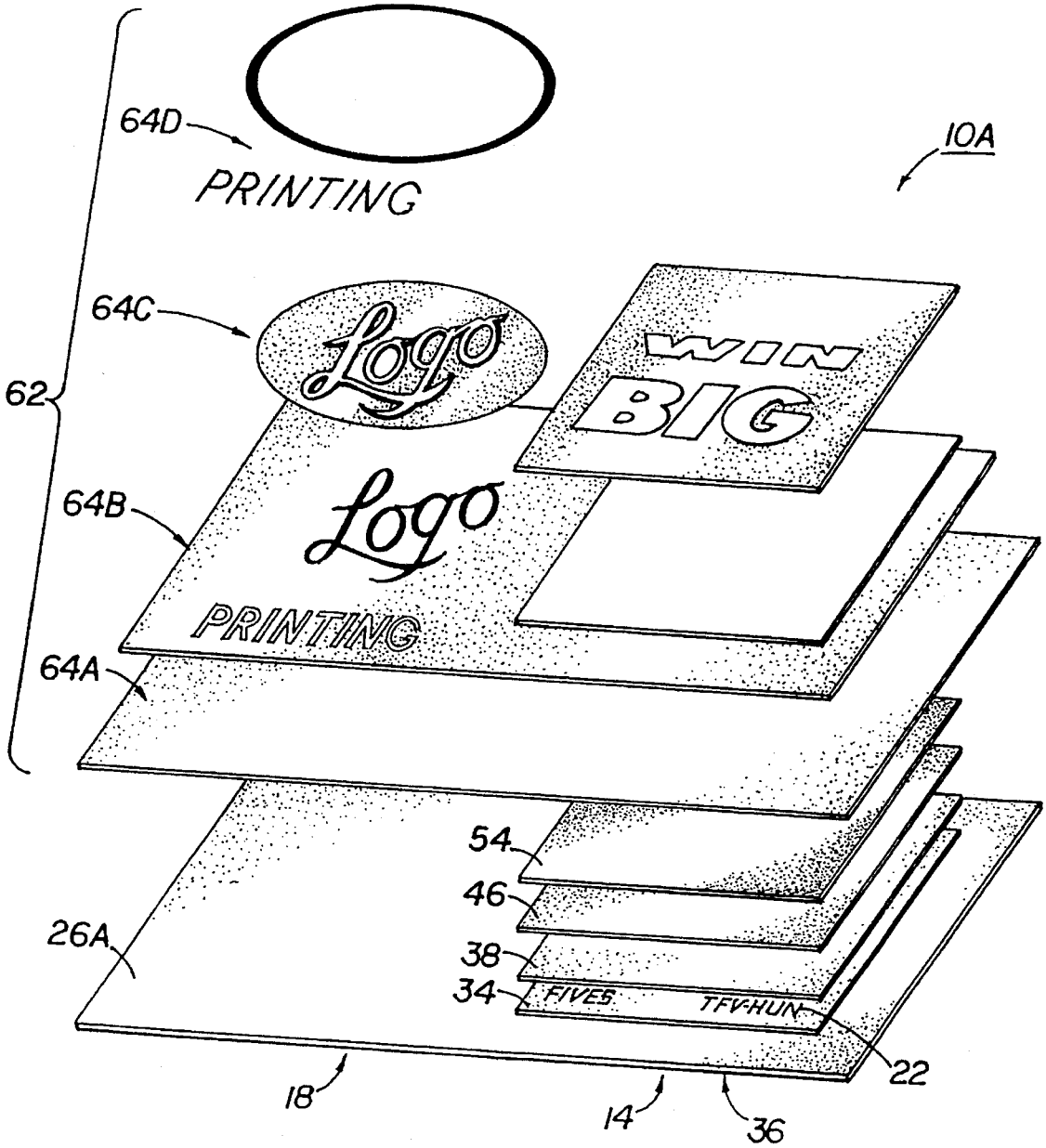
FIG. 2 is an exploded perspective view of an alternative card having a foil, rather than paper, base.

FIGS. 1–2 show various ink layers and coatings that may be applied to bases 26 and 26A to enhance the security of cards 10 and 10A. As detailed FIG. 1, foundation coating 30 covers the portion of base 26 in secure area 14. Foundation coating 30 increases the opacity of card 10, reducing the possibility of successful optical compromise through candling. Cards 10 and 10A may also include contrast coating 34 if desired, typically a white or light-colored material onto which darker symbols are printed. Both foundation coating 30 and contrast coating 34 (when present) are adapted to receive the ink used to print symbols 22 and, for card 10, provide a durable surface to substitute for that furnished by the foil of card 10A.

Foundation coating 30 comprises a dark-colored, solvent-soluble ink (e.g. blue) with a high metal content (typically aluminum, bronze, or copper) and a vinyl chloride base resin. Foundation coating 30 additionally may, but need not, include carbon black to inhibit electrostatic tampering from the underside 36 of card 10. Like the foil of card 10A, the colored ink and other contents of foundation coating 30 further prevent unscrupulous players from viewing symbols 22 by removing the fibers from base 26. The fugitive dye of foundation coating 30 (if present) also is designed to bleed through underside 36 of card 10 when immersed in chemicals, evidencing an attempt to wick the ink of symbols 22 to underside 36 for viewing by an unscrupulous player. A suitable contrast coating 34 for card 10 is a vinyl chloride resin (dissolved in acetate solvent) with titanium dioxide pigment.

Seal coating 38 covers symbols 22 and functions as a barrier to seal symbols 22 from other coatings applied to cards 10 and 10A and guard against chemical tampering by unscrupulous players. Cards 10 and 10A may additionally include a second sealant (not shown) for similar purposes and to reduce reliance on automatic equipment fully covering symbols 22 with seal coating 38. In these embodiments, either or both of seal coating 38 and the second sealant may be a water-white solution of vinyl chloride resin. Although transparent, either seal coating 38 or the second sealant may be tinted if desired to inhibit or deter photocopying of symbols 22.

At least one release coating 46, applied over seal coating 38, permits first and second latex coverings 54 and 58, when present, to be removed by the player to reveal symbols 22. Release coating 46 typically contains alcohol-soluble polyamide resin and zinc stearate, and may contain silicone as well. This structure permits card 10 to withstand greater temperatures without degradation than other typical non-foil pieces, reducing the possibility of successful heat-based tampering by unscrupulous players. Utilizing more than one release coating 46 allows each to be thinner than a single coat, furthermore, thereby drying more quickly and allowing more rapid processing through automatic equipment. Multiple release coatings 46 also promote complete coverage of secure area 14 and facilitate more rapid and easier removal of respective first and second (latex) coverings 54 and 58 by the player.

Alternatively, release coating 46 may be a varnish cured by ultraviolet radiation to enhance the gloss of card 10 and further seal the layers of the card 10 from contaminants or abrasion. Because this coating 46 is not air-dried, it remains unfixed until exposed to ultraviolet radiation. Non-uniformities in the thickness of applied coating 46, therefore, remain amenable longer to correction, providing a smoother, glossier result than many air-dried coatings. Exemplary compositions for such release coating 46 include (by weight) approximately 55–65% monomer, 15–25% epoxy oligomer, 8–10% benzophenon and, if appropriate, various anti-foamants, flow/levelling agents, photo-initiators, and synergists. Because these components cross-link when exposed to ultraviolet radiation, this alternative release coating 46 typically cures to a hard and durable finish. The alternative release coating 46 may additionally substitute for either or both of seal coating 38 or the second sealant (and may therefore also include a colorant).

Applied atop release coating 46 is first covering 54. First covering 54 is an opaque, typically (although not necessarily) black latex comprised of solvent-soluble synthetic rubber with predispersed pigment and is available from KVK USA, 19A Home News Road, New Brunswick, N.J. 08901. Second covering 58, applied atop first covering 54 of FIG. 1, is also an opaque, solvent-soluble synthetic rubber containing predominantly metal particles (such as aluminum, copper, or bronze) and black pigment. First and second coverings 54 and 58 combine to inhibit candling of card 10, with the metallic composition and black pigment present additionally deterring certain chemical tampering of both cards 10 and 10A. Because the synthetic rubber of first and second coverings 54 and 58 is an electrical insulator and does not react with acids or bases, cards 10 and 10A are less likely to be electrically or chemically compromised by an unscrupulous player as well. In some embodiments of cards 10 and 10A, first covering 54 may also include metal particles to enhance opacity, or be otherwise appropriately formulated to provide a removable means for obscuring symbols 22 from view.

Overprinting 62, finally, may also be applied to cards 10 and 10A. Overprinting 62 comprises one or more inks 64, each adapted to adhere suitably to each of (paper) base 26, (foil) base 26A, and the latex or other material used as either first covering 54 or second covering 58. Consistent with FIGS. 1–2, use of no more than four inks 64A–D (and only three if black ink 64D is excluded) permits creation of vibrant graphics in virtually all colors for both secure area 14 and unsecure area 18 of cards 10 and 10A. By contrast, existing cards require twice the number of inks—and thus twice the number of print stations—to accomplish this purpose, one set each for secure area 14 and unsecure area 18. Of course, if desired more than four inks 64 may be used in connection with the present invention.

Typical formulations of inks 64 include, by weight:

| | |
|---|---|
| ethyl acetate | 19–58% |
| colored nitrocellulose chips | 1–25% |
| acrylic resin | 15–25% |
| propyl acetate | 20–60%, |

with the colored nitrocellulose chips determining the color of each ink 64 (e.g., yellow for ink 64A, magenta for ink 64B, cyan for ink 64C, black for ink 64D). These chips are commercially available from numerous manufacturers, including BASF, KVK USA, and PennColor. In a preferred embodiment, each ink 64 has, by weight, 30% ethyl acetate, 11% colored nitrocellulose chips, 19% acrylic resin, and 40% propyl acetate. Polyamide resins (in quantities typically ranging between 1–35% by weight) and spirit-soluble nitrocellulose (in quantities typically ranging between 5–30% by weight and having viscosity of approximately 18–25 cps) may also be added (or substituted for the acrylic resin) if desired.

By functioning in both secure area 14 and unsecure area 18, inks 64 permit continuous printing, and thus graphical continuity or integration, in both areas. Doing so also masks the boundaries of first and second coverings 54 and 58, inhibiting their improper removal by making the boundaries substantially more difficult to locate visually. Using inks 64 to provide integrated overprinting 62 further improves registration of the components of the overall design, usually resulting in enhanced aesthetic appeal. As formulated, inks 64 additionally reduce blocking when cards 10 or 10A are wound in a roll.

Using inks 64 provides other advantages for gravure, flexo, letter press, and possibly silk screen printing processes as well. By eliminating the need for additional printing stations, for example, inks 64 reduce both the cost of and "make ready" time for a printing effort. The unused printing stations, moreover, are available for other jobs or efforts running concurrently.

The foregoing is provided for purposes of illustrating, explaining, and describing embodiments of the present invention. Modifications and adaptations to these embodiments will be apparent to those skilled in the art and may be made without departing from the scope or spirit of the invention. In particular, white ink 64 may also be formulated and applied atop first covering 54 or second covering 58 if desired.

We claim:

1. A card comprising:

a. a base comprising a first area and a second area;

b. symbols applied in the first area of the base;

c. removable means, in the form of an opaque coating applied in the first area, for obscuring the symbols from view; and d. at least one ink of a specific formulation applied atop both the opaque coating and the second area of the base.

2. A card according to claim 1 in which the ink comprises ethyl acetate, colored nitrocellulose chips, and propyl acetate.

3. A card according to claim 2 in which the ink consists essentially of ethyl acetate, colored nitrocellulose chips, acrylic resin, and propyl acetate.

4. A card according to claim 3 in which the ink consists essentially of, by weight, 19–58% ethyl acetate, 1–25% colored nitrocellulose chips, 15–25% acrylic resin, and 20–60% propyl acetate.

5. A card according to claim 4 in which the ink consists essentially of, by weight, 30% ethyl acetate, 11% colored nitrocellulose chips, 19% acrylic resin, and 40% propyl acetate.

6. A card according to claim 1 in which the opaque coating comprises at least one opaque synthetic rubber containing metal particles.

7. A card according to claim 6 further comprising a coating, interposed between the first area of the base and the symbols, for providing visible contrast between the base and symbols.

8. A card according to claim 7 further comprising a release coating interposed between the symbols and opaque coating.

9. A card according to claim 8 in which the base is made of paper.

10. A card according to claim 8 in which the base comprises foil.

11. A card comprising:

a. a base having a first area and a second area;

b. a contrast coating, comprising vinyl chloride resin with titanium dioxide pigment, applied in the first area of the base;

c. symbols printed onto the contrast coating;

d. a sealant applied to the symbols;

e. a release coating applied to the sealant;

f. at least one opaque covering applied to the release coating and comprising a solvent-soluble synthetic rubber; and g. at least one ink applied to both the second area of the base and the opaque coating, which ink consists essentially of, by weight, 19–58% ethyl acetate, 1–25% colored nitrocellulose chips, 20–60% propyl acetate, and at least one of the following: 15–25% acrylic resin, 1–35% polyamide resin, and 5–30% nitrocellulose.

12. A card comprising:

a. a base comprising a first area and a second area;

b. symbols applied in the first area of the base;

c. a removable, opaque covering applied in the first area of the base to obscure the symbols from view, which covering defines a visible boundary between the first area of the base and the second area of the base; and d. means, in the form of an ink, for masking the boundary from view.

13. A card according to claim 12 in which the ink is applied to both the second area of the base and the opaque covering and comprises ethyl acetate, colored nitrocellulose chips, and propyl acetate.

14. A card according to claim 13 in which the ink consists essentially of, by weight, 19–58% ethyl acetate, 8–17% colored nitrocellulose chips, 15–25% acrylic resin, and 20–60% propyl acetate.

* * * * *